United States Patent [19]

Staskiewicz et al.

[11] Patent Number: 4,621,791

[45] Date of Patent: Nov. 11, 1986

[54] BOARD STRAIGHTENER

[76] Inventors: Vincent P. Staskiewicz; George Spector, both of 233 Broadway Rm 3615, New York, N.Y. 10007

[21] Appl. No.: 745,535

[22] Filed: Jun. 17, 1985

[51] Int. Cl.[4] ..... B66F 3/00

[52] U.S. Cl. ..... 254/17

[58] Field of Search ..... 254/11, 15–17, 254/120, 25; 29/267, 271

[56] References Cited

U.S. PATENT DOCUMENTS 1,665,430 4/1928 Arzt ..... 254/17

1,801,810 4/1931 Goodson ..... 254/17

*Primary Examiner*—Robert C. Watson

[57] ABSTRACT

A board straightener tool is provided and consists of a hand lever pivotally connected to a saddle placed on a joist so that the hand lever can come into contact with a board on top of the joist and by using leverage move the board to decrease size of a gap between the board and another board for constructing decks.

2 Claims, 6 Drawing Figures

BOARD STRAIGHTENER

BACKGROUND OF THE INVENTION

The instant invention relates generally to tools and more specifically it relates to a board straightener tool used in conjunction with building decks or the like.

Numerous tools have been provided in prior art that are adapted to position and hold various articles in place so that the articles can be secured. For example U.S. Pat. Nos. 1,801,810; 1,919,090 and 2,188,819 all are illustrative of such prior art. While these units may be suitable for the particular purpose to which they address, they would not be as suitable for the purpose of the present invention as heretofore described.

SUMMARY OF THE INVENTION

A principle object of the present invention is to provide a board straightener tool that uses leverage to decrease the size of the gap between boards for construction of decks.

Another object is to provide a board straightener tool that by placing the saddle end of the tool over or under a joist and pulling the hand lever against the board it will pull the board into proper alignment so that the board can be nailed in place by at least one person.

An additional object is to provide a baord straightener tool that can have an adjustment device within the saddle end of the tool so that it can be used with various sized joists.

A further object is to provide a board straightener tool that is economical in cost to manufacture.

A still further object is to provide a board straightener tool that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
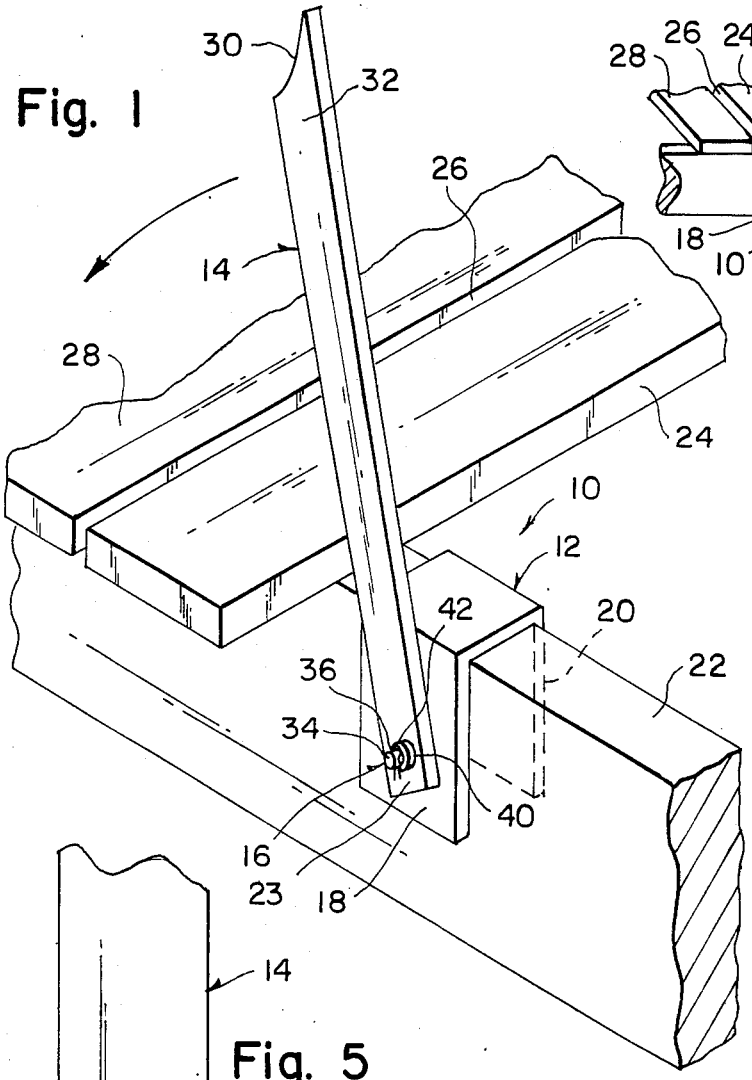
FIG. 1 is a perspective view of the invention with the saddle placed on top of a joist.
Figure 2:
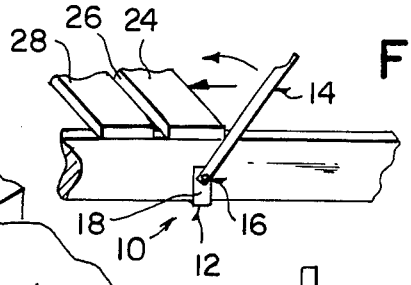
FIG. 2 is a perspective view of the invention with the saddle placed on bottom of the joist.
Figure 3:
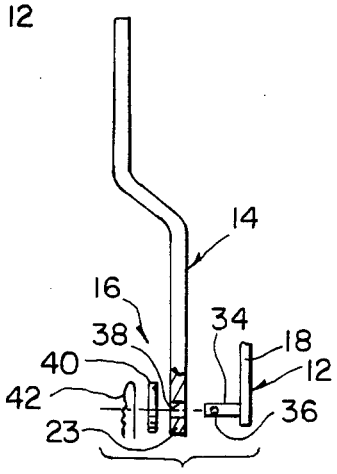
FIG. 3 is an exploded side view with parts broken away showing a bent shaped hand lever.

Turning now descriptively to the drawings, in which similar reference characters denote similar elements throughout the several views, FIGS. 1 through 3 illustrates a board straightener tool 10 that consists of a U-shaped saddle 12, a hand lever 14 and a pivotal connection 16.

The U-shaped saddle 12 has two spaced apart arms 18, 20 so that the saddle can be either placed over a joist 22 shown in FIG. 1 or under the joist as shown in FIG. 2. The pivotal connection 16 is between bottom end 23 of the hand lever 14 and arm 18 of the saddle 12. The hand lever 14 can come into contact with a board 24 on top of the joist 22 and by using leverage move the board to decrease size of a gap 26 between the board 24 and another board 28 for constructing decks.

The hand lever 14 has a pry bar 30 at top end 32 so that when the hand lever is removed from the pivotal connection 16 the pry bar 30 can be used to increase size of the gap 26 between the boards 24 and 28.

The pivotal connection 16 consists of a shaft 34 mounted transversely to the arm 18 of the saddle 12. The shaft 34 has a transverse aperture 36 at free end. The hand lever 14 has a hole 38 at the bottom end 23 so that the hand lever can pivot about the shaft 34. A washer 40 is palced on the shaft 34 and a clevis pin 42 is placed through the transverse aperture 36 at the free end of the shaft 34 to hold the washer 40 and the hand lever 14 thereto.

Figure 4:
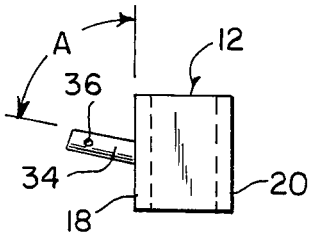
FIG. 4 is a top view of the saddle showing the shaft at an obtuse angle thereto.

The hand lever 14 can be straight as shown in FIGS. 1 and 2 or be bent as shown in FIG. 3 to make it more comfortable to use. The shaft 34 can be mounted at a right angle to the arm 18 of the saddle 12 as shown in FIG. 3 or at an obtuse angle "A" shown in FIG. 4. If the shaft 34 is mounted at the obtuse angle "A", then when the hand lever 14 comes into contact with the board 24 the saddle 12 will twist to make better contact with the joist 22.

Figure 5:
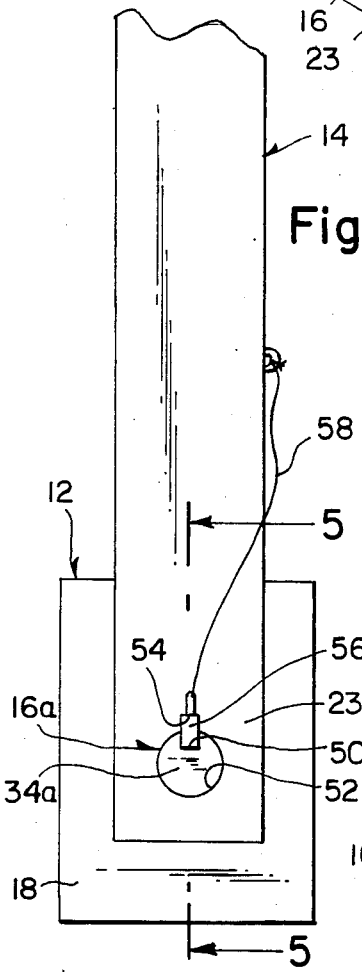
FIG. 5 is a front view of a modified hand lever having a removable key 50 that the hand lever can pivot around the shaft.
Figure 6:
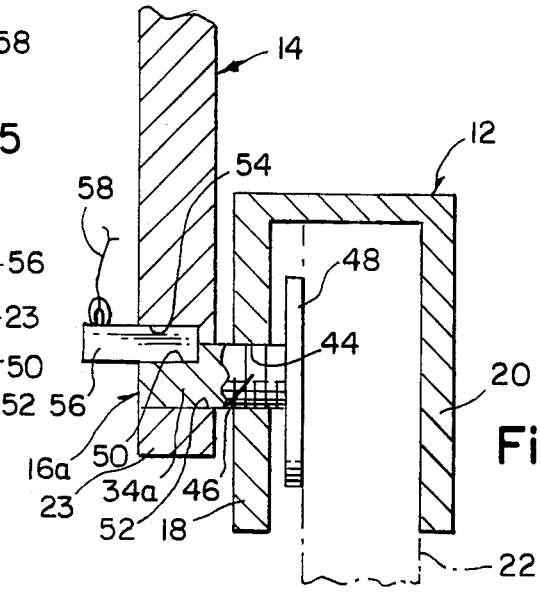
FIG. 6 is a cross sectional view taken along line 5—5 in FIG. 4 showing the shaft threaded so that the shaft can be used as an adjustment device for various sized joists when the key is inserted.

FIGS. 5 and 6 show a modified pivotal connection **16*a*. The arm 18 of the saddle 12 has a threaded aperture 44 therethrough. A shaft 34*a* is provided and has threads 46 and a large flat head 48 at one end and a keyway 50 at other end. The threads 46 of the shaft 34*a* are in engagement with the threaded aperture 44 in the arm 18 of the saddle 12 so that the large flat head 48 will be inside the saddle 12 between the arms 18 and 20. The hand lever 14 has a hole 52 with a keyway 54 at the bottom end 23 so that the hand lever 14 can pivot about unthreaded portion of the shaft 34*a***.

A key 56 will engage the keyway 54 of the hand lever 14 and the keyway 50 of the shaft **34*a*. When the key 56 is installed the hand lever 14 will turn the shaft 34*a* until the large flat head 48 will contact side of the joist 22 and clamp the joist to the other arm 20. A tether 58 can be connected between the key 56 and the hand lever 14 to prevent loss thereof when the key 56** is removed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A board straightener tool which comprises:

(a) a U-shaped saddle having two spaced apart arms so that said saddle can be placed on a joist;

(b) a hand lever; and (c) a pivotal connection between bottom end of said hand lever and one of said arms of said saddle so that said hand lever can come into contact with a board on top of said joist and by using leverage move said board to decrease size of a gap between said board and another board for constructing decks, wherein said hand lever includes a pry bar at top end so that when said hand lever is removed from said pivotal connection said pry bar can be used to increase size of said gap between said boards, wherein said pivotal connection comprises:

(d) a shaft mounted transversely to said arm of said saddle, said shaft having a transverse aperture at free end;

(e) said hand lever having a hole at said bottom end so that said hand lever can pivot about said shaft;

(f) a washer placed on said shaft; and (g) a clevis pin placed through said transverse aperture at said free end of said shaft to hold said washer and said hand lever thereto, wherein said shaft is mounted at an obtuse angle to said arm of said saddle so that when said hand lever comes into contact with said board said saddle will twist to make better contact with said joist.

2. A board straightener tool which comprises:

(a) a U-shaped saddle having two spaced apart arms so that said saddle can be placed on a joist;

(b) a hand lever; and (c) a pivotal connection between bottom end of said hand lever and one of said arms of said saddle so that said hand lever can come into contact with a board on top of said joist and by using leverage move said board to decrease size of a gap between said board and another board for constructing decks, wherein said hand lever includes a pry bar at top end so that when said hand lever is removed from said pivotal connection said pry bar can be used to increase size of said gap between said boards, wherein said pivotal connection comprises:

(d) said arm of said saddle having a threaded aperture therethrough;

(e) a shaft having threads and a large flat head at one end and a keyway at other end, said threads of said shaft in engagement with said threaded aperture in said arm of said saddle so that said large flat head will be inside said saddle between said arms;

(f) said hand lever having a hold with a keyway at said bottom end so that said hand lever can pivot about the unthreaded portion of said shaft; and (g) a key to engage said keyways of said hand lever and said shaft so that when said key is installed said hand lever will turn said shaft until said large flat head will contact side of said joist and clamp said joist to other said arm.

* * * * *